US005650580A

United States Patent [19]

Yamamoto et al.

[11] Patent Number: 5,650,580

[45] Date of Patent: Jul. 22, 1997

[54] AUTOMATIC PLAYING SYSTEM FOR ACOUSTIC MUSICAL INSTRUMENT

[75] Inventors: Jun Yamamoto; Haruki Uehara, both of Shizuoka, Japan

[73] Assignee: Yamaha Corporation, Japan

[21] Appl. No.: 411,554

[22] Filed: Mar. 28, 1995

[30] Foreign Application Priority Data

Mar. 28, 1994 [JP] Japan ..... 6-080902

[51] Int. Cl.[6] ..... G10F 1/02

[52] U.S. Cl. ..... 84/21

[58] Field of Search ..... 84/615–621, 626–633, 84/658, 687–690, 2, 3, 21, 22, 115, DIG. 7

[56] References Cited

U.S. PATENT DOCUMENTS 4,972,753 11/1990 Adachi et al. ..... 84/658 X 5,097,741 3/1992 Kikumoto ..... 84/658 X 5,119,712 6/1992 Kato ..... 84/658 X

*Primary Examiner*—Stanley J. Witkowski

*Attorney, Agent, or Firm*—Graham & James LLP

[57] ABSTRACT

An automatic playing system sequentially rotates keys of an acoustic piano for reproducing a performance, and a controlling unit supplies a preliminary section and a post-treatment section to a solenoid coil of an actuator unit before and after a main section of a driving signal, respectively; the preliminary section gently comes into contact with the key before a plunger of the actuator unit starts a rotation of the key without a noise; and the post-treatment section causes the key to softly land on a back rail without a noise.

19 Claims, 5 Drawing Sheets

AUTOMATIC PLAYING SYSTEM FOR ACOUSTIC MUSICAL INSTRUMENT

FIELD OF THE INVENTION

This invention relates to an automatic playing system an acoustic musical instrument and, more particularly, to an automatic playing system for selectively driving solenoid-operated actuator units associated with an acoustic musical instrument.

DESCRIPTION OF THE RELATED ART

A typical example of the automatic playing system is incorporated in an automatic player piano, and performs a music instead of a player. The automatic playing system causes solenoid-operated actuator units to sequentially drive keys of a keyboard at given timings, and removes the driving forces from the keys at expiry of driving terms.

FIGS. 1A and 1B illustrate the waveforms of the driving signals DR1 and DR2 supplied to the solenoid-operated actuator units. The driving signal DR1 is used for a relatively greater loudness such as mezzo forte to fortissimo, and a relatively soft tone expressed by mezzo piano to pianissimo is reproduced by using the driving signal DR2. Each driving signal DR1/DR2 is broken down into a first attack section AT1 indicative of a first attack data, a second attack section AT2 indicative of a second attack data, a touch section TD indicative of a touch data and a maintenance section KD indicative of a maintenance data, and the first attack section AT1 rises at a key-on timing KON. The first attack section AT1 is supplied to the solenoid-operated actuator unit, and is followed by the second attack section AT2. Then, the solenoid-operated actuator unit projects the plunger, and the plunger is brought into contact with the associated key. With the touch data, the solenoid-operated actuator unit causes the key action mechanism to drive the hammer for rotation, and the hammer strikes the strings at a given impact. The strings vibrate, and generate an acoustic tone. After the generation of the acoustic tone, the maintenance section causes the solenoid-operated actuator unit to maintain the plunger, and, accordingly, the key remains in the depressed state for a short while. When the maintenance section KD is expired, the solenoid-operated actuator unit immediately retracts the plunger, and the key is released.

The automatic player piano driven by the driving signals DR1 and DR2 encounters a problem in undesirable noise. Namely, when the plunger is brought into contact with the bottom surface of the key, the noise is generated. After the rapid removal of the maintenance section, the rear portion of the key violently impacts on the back rail, and the noise is generated again.

In order to eliminate the undesirable noise from the automatic player piano, a solution was proposed. According to the proposed solution, a spring 1 is inserted between a plunger and a solenoid 3 as shown in FIG. 2, and urges the plunger 2 toward a key 4. The elastic force of the spring 1 forces the plunger 2 to be held in contact with the bottom surface of the key 1 at all times. Thus, the spring 1 eliminated a gap between the plunger 2 and the key 4, and the undesirable noise is not generated upon actuation of the key 4.

Another solution is to provide a soft cushion member at the leading end of the plunger, and the soft cushion member takes up an impact between the plunger and the bottom surface of the key.

Although the solutions are free from the undesirable noise generated at the impact between the key and the plunger, they encounter other problems inherent in these solutions. Namely, the first solution, i.e., the spring 1 inserted between the solenoid 3 and the plunger 2 changes the key touch in an original performance by a player, because the plunger 2 comes into collision with the bottom surface of the solenoid 3; and the solenoid-operated actuator unit 1/2/3 is so complex that the production cost is rather high.

On the other hand, the second solution, i.e., the soft cushion member changes the reproduced performance from the original performance. In detail, when the soft cushion member is brought into contact with the bottom surface of the key, the soft cushion member per se is deformed so as to take up the noise, and the deformed soft cushion member rotates the key. If the plunger gently pushes the key for mezzo piano or pianissimo, the deformation of the soft cushion member is rather small, and only a small amount of time delay is introduced between the motion of the plunger and the motion of the key. However, if the plunger strongly pushes the key for mezzo forte or fortissimo, the deformation of the soft cushion member is rather large, and relatively long time delay is introduced between the motion of the plunger and the motion of the key. Thus, the time delay is variable depending upon the loudness of the reproduced tone, and the original performance is undesirably changed by the soft cushion member.

SUMMARY OF THE INVENTION

It is therefore an important object of the present invention to provide a simple automatic playing system for which allows an acoustic musical instrument to faithfully reproduce a performance without a noise and a change of key touch.

To accomplish the object, the present invention proposes to preliminarily engage a force-transmitting sub-means with a tone generating means and/or to decelerate the tone generating means on the way toward a home position thereof.

In accordance with one aspect of the present invention, there is provided an automatic playing system associated with an acoustic musical instrument having tone generating mechanisms for generating acoustic tones, comprising: a data supplying means for successively supplying a plurality of pieces of tone intensity data each representative of a loudness of a tone produced by the acoustic musical instrument; and a plurality of driving means respectively associated with the tone generating mechanisms, and having respective stationary sub-means and respective force-transmitting sub-means movable with respect to the respective stationary sub-means, the plurality of driving means being responsive to the pieces of tone intensity data so as to cause the force-transmitting sub-means to exert forces corresponding to the pieces of tone intensity data on the tone generating mechanisms, the data supplying means further supplying pieces of preliminary driving data to the plurality of driving means so as to maintain the force-transmitting sub-means in contact with the tone generating means in the absence of the pieces of tone intensity data.

In accordance with another aspect of the present invention, there is provided an automatic playing system associated with an acoustic musical instrument having tone generating mechanisms movable between respective home positions to respective tone generating positions for generating acoustic tones, comprising: a data supplying means for successively supplying a plurality of pieces of tone intensity data each representative of a loudness of a tone produced by the acoustic musical instrument; and a plurality of driving means respectively associated with the tone generating mechanisms, and having respective stationary sub-means and respective force-transmitting sub-means movable with respect to the respective stationary sub-means, the plurality of driving means being responsive to the pieces of tone intensity data so as to cause the force-transmitting sub-means to exert forces corresponding to the pieces of tone intensity data on the tone generating mechanisms, the data supplying means further supplying pieces of deceleration data to the plurality of driving means so as to decelerate the tone generating mechanisms while the tone generating mechanisms are moving from the tone generating positions toward the home positions, thereby causing the tone generating mechanisms to softly terminating at the home positions.

BRIEF DESCRIPTION OF THE DRAWINGS

The features and advantages of the automatic playing system according to the present invention will be more clearly understood from the following description taken in conjunction with the accompanying drawings in which.

DESCRIPTION OF THE PREFERRED EMBODIMENT

Figure 1A:
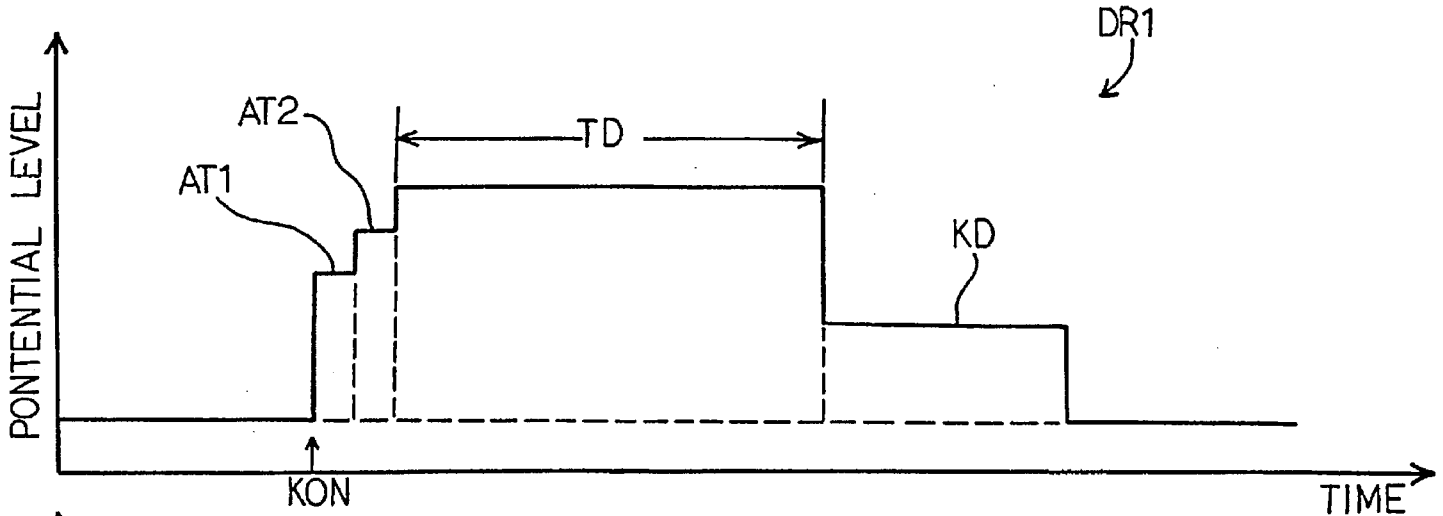
Fig. 1A PRIOR ART
FIGS. 1A and 1B are diagrams showing the waveforms of the driving signals supplied to the prior art automatic playing system for driving the keys at different loudness.
Figure 1B:
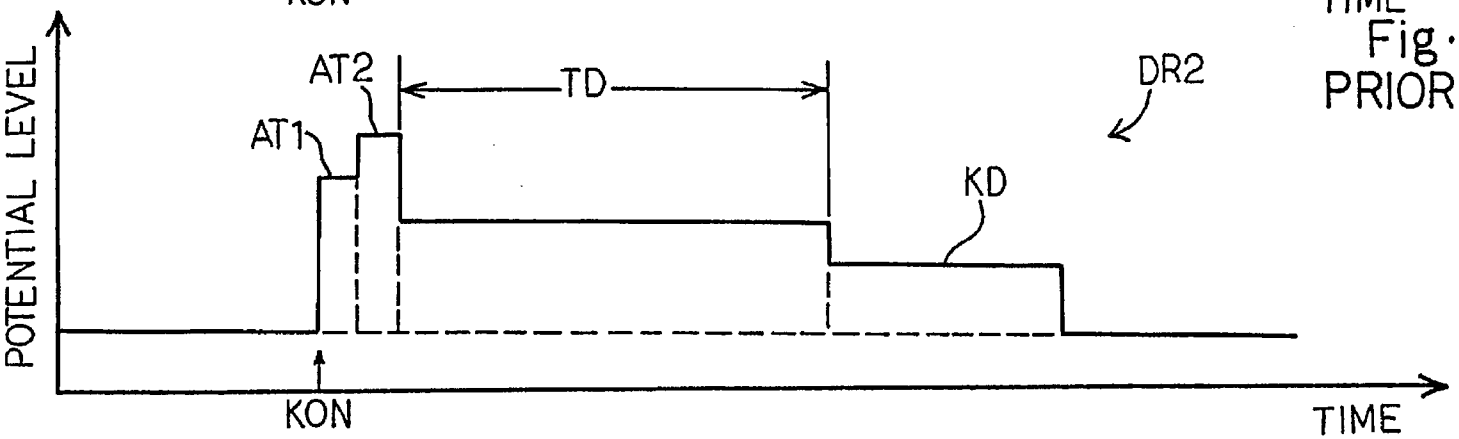
Fig. 1B PRIOR ART
Figure 2:
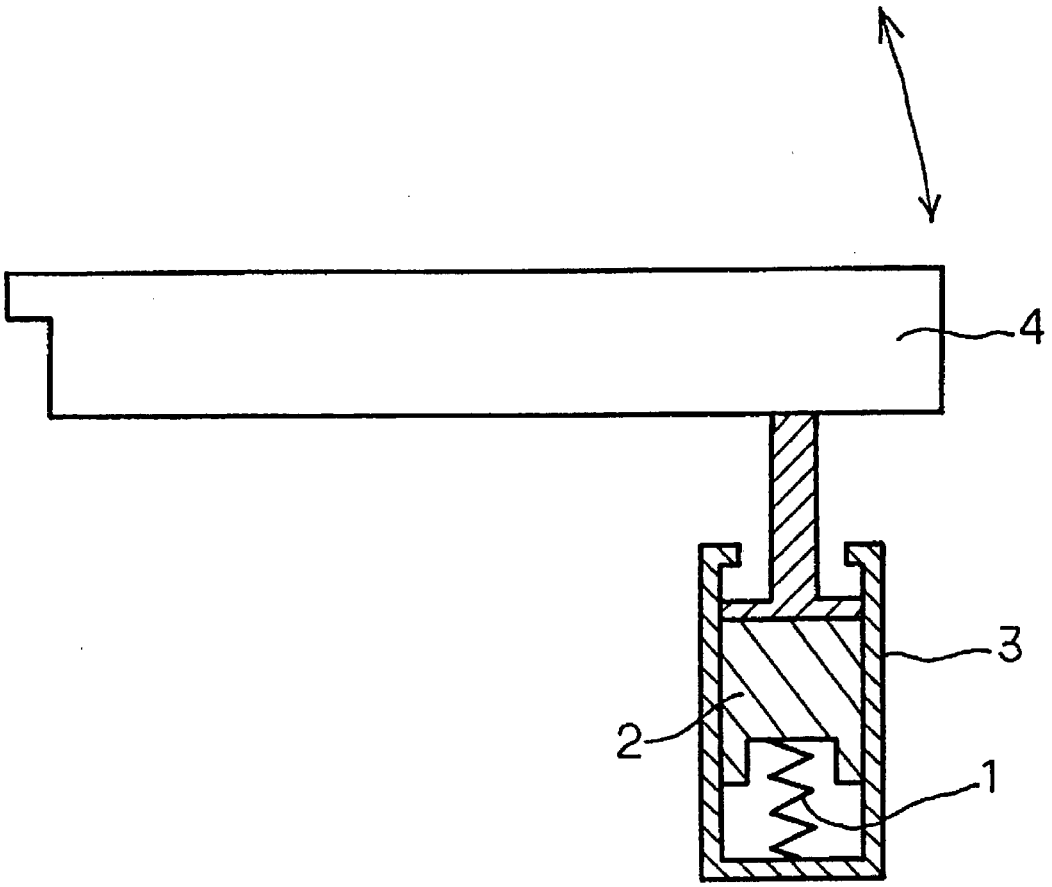
Fig·2 PRIOR ART
FIG. 2 is a partially cross sectional view showing the proposed solution for eliminating the noise.
Figure 3:
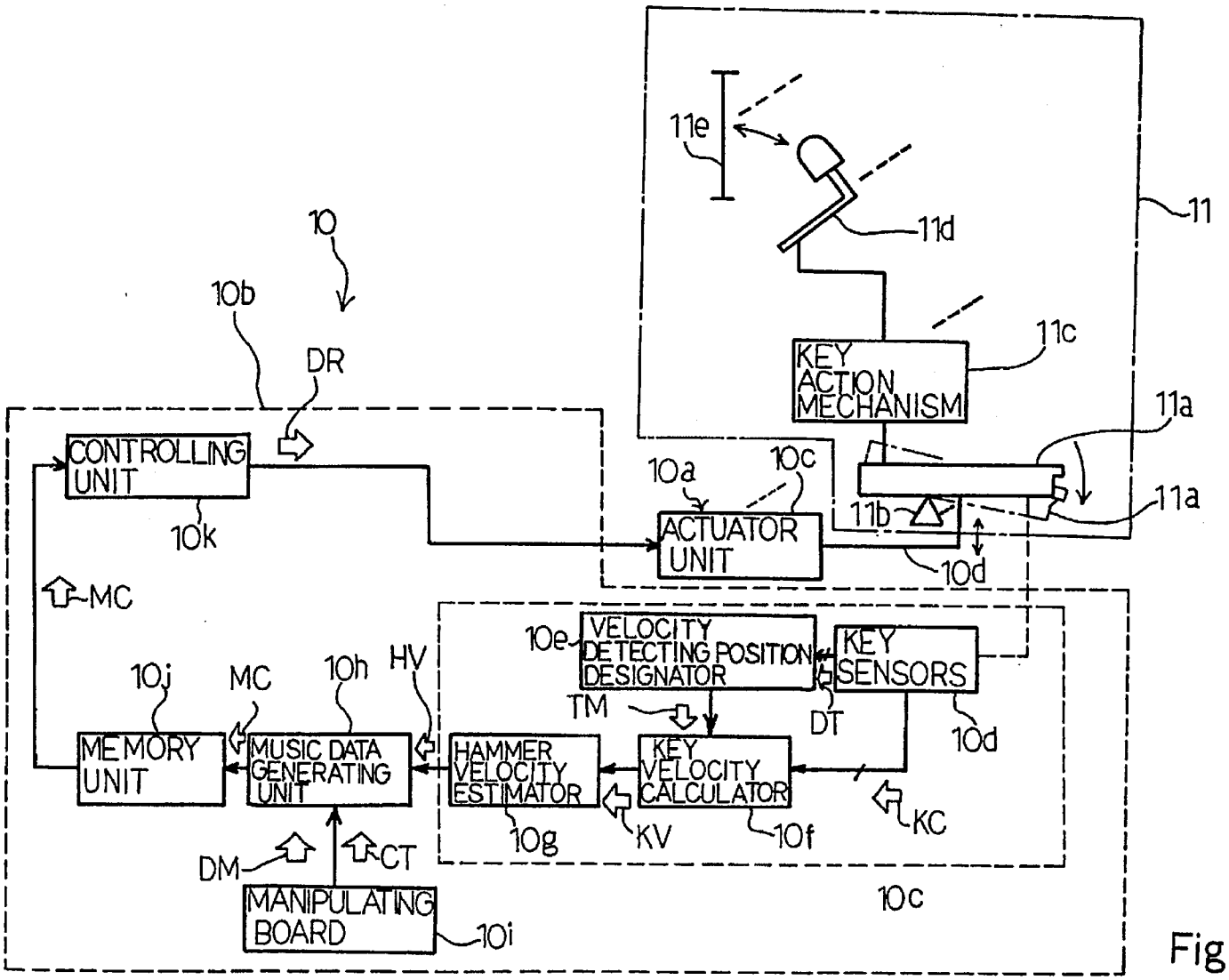
FIG. 3 is a block diagram showing an automatic playing system provided for an acoustic piano.

Referring to FIG. 3 of the drawings, an automatic playing system 10 is provided for an acoustic piano 11 having a plurality of keys 11*a* turnable around respective balance key pins 11*b*, a plurality of key action mechanisms 11*c* functionally connected to the rear end portions of the keys 11*a*, respectively, a plurality of hammer assemblies 11*d* driven for rotation by the key action mechanisms 11*c* and a plurality of sets of strings 11*e* struck by the plurality of hammer assemblies 11*d*, respectively. In the following description, each key 11*a* remains in a rest position without force exerted by a player or the automatic playing system, and reaches an end position at a termination of the key motion caused by the force.

The acoustic piano 11 is of a standard type, and is well known to a person skilled in the art. For this reason, no further description on the acoustic piano 11 is incorporated hereinbelow. The acoustic piano 11 may be of the grand type.

The automatic playing system 10 largely comprises a plurality of solenoid-operated actuator units 10*a* and a data supplying sub-system 10*b*. The plurality of solenoid-operated actuator units 10*a* are respectively associated with the keys 11*a*, and each of the solenoid-operated actuator units 10*a* has a solenoid coil 10*c* stationary with respect to the balance key pins 11*b* and a plunger 10*d* movable with respect to the solenoid coil 10*c*. The plurality of solenoid-operated actuator units 10*a* serve as a plurality of driving means, and the solenoid coil 10*c* serves as a stationary sub-means. The plunger 10*d* transfers a force to the associated key 11*a*, and behaves as a force-transmitting sub-means 10*d*.

The data supplying sub-system 10*b* comprises an impact estimating unit 10*c* having a plurality of key sensors 10*d*, a velocity detecting position designator 10*e*, a key velocity calculator 10*f* and a hammer velocity estimator 10*g*, and the impact estimating unit 10*c* estimates a final velocity of the hammer assembly 11*d* associated with each key 11*a* to be rotated. The final hammer velocity is in proportion to the intensity of the impact of the hammer assembly 11*d* on the set of strings 11*e*.

The plurality of key sensors 10*d* are respectively associated with the keys 11*a*, and each of the plurality of key sensors 10*c* has two photo-couplers provided along a path of the associated key 11*a* between the rest position and the end position. The key sensors 10*d* monitor the associated keys 11*a* so as to generate a key code signal KP indicative of a depressed key 11*a*, and the key code signal KC is supplied to the key velocity calculator 10*f*. When the optical beam of one of the photo-couplers is interrupted due to the depressed key 11*a*, the key sensor 10*d* generates a detecting signal DT indicative of the photo-coupler radiating the interrupted optical beam, and the detecting signal DT is supplied to the velocity detecting position designator 10*e*. The depressed key 11*a* sequentially interrupts the optical beams of the associated key sensor 10*d*, and the sequential interruption is reported to the velocity detecting position designator 10*e*.

The velocity detecting position designator 10*e* discriminates the photo-couplers radiating the optical beams sequentially interrupted, and supplies a timing signal TM indicative of the timings at which the optical beams of the photo-couplers are sequentially interrupted. The timing signal TM is supplied to the key velocity calculator 10*f*.

The key velocity calculator 10*f* determines a time interval between the timings indicated by the timing signal TM, and calculates a key velocity for the depressed key 11*a* indicated by the key code signal KC by dividing a gap between the two photo-couplers by the time interval. The key velocity calculator 10*f* generates a key velocity signal KV indicative of the key velocity of the depressed key 11*a*. The key velocity signal KV is supplied to the hammer velocity estimator 10*g*.

The key velocity at a particular point on the path relates to the final hammer velocity, and the final hammer velocity is in proportion to the intensity of the impact of the hammer assembly 11*d* on the strings 11*e* as described hereinbefore. For this reason, the hammer velocity estimator 10*g* is responsive to the key velocity signal KV, and converts the key velocity into the final hammer velocity, thereby estimating the intensity of the impact of the hammer assembly 11*d* on the strings 11*e*. The hammer velocity estimator 10*g* generates a hammer velocity signal HV indicative of the intensity of the impact.

The data supplying sub-system 10*b* further comprises a music data generating unit 10*h* for generating a series of music data codes MC representative of an original performance carried out by a player on the keys 11*a*, a manipulating board 10*i* connected to the music data generating unit 10*h* and a memory unit 10*j* for storing the music data codes MC.

A plurality of manipulating switches are provided on the manipulating board 10*i*, and are manipulated by the player.

A group of the manipulating switches is assigned to a damping data indicative of a reverse thrust against a released key 11*a*. The manipulating switches of the group regulate the number of steps (which are described in detail with reference to FIG. 4), the magnitude of each step and a time period of each step. The reverse thrust step-wise varied makes a released key smoothly decelerated, and properties of the acoustic piano 11 and the characteristics of the solenoid-operated actuator units 10*a* are taken into account when the number of steps, the magnitude of each step and the time period for each step are determined.

When an operator selectively changes the number of steps, the magnitude of each step and the time period of each step, the manipulating switches assigned to the damping data generate a damping data signal DM indicative of the number of newly provided steps, the magnitude of each newly provided step and the time period of each newly provided step, and the damping data signal DM is supplied to the music data generating unit 10*h*.

Another group of manipulating switches is assigned to a preliminary contact data indicative of a forward thrust causing the plunger 10*d* of each solenoid-operated actuator unit 10*a* to be lightly in contact with the bottom surface of the associated key 11*a* staying in the rest position. The manipulating switches of the second group regulate the number of steps (which are also described in detail with reference to FIG. 4), the magnitude of each step and a time period of each step. The forward thrust step-wise varied causes the plungers 10*d* to gently come into contact with the associated keys 11*a* before the solenoid-operated actuator units 10*a* drive the associated keys 11*a* for rotation, and the properties of the acoustic piano 11 and the characteristics of the solenoid-operated actuator units 10*a* are also taken into account when the number of steps, the magnitude of each step and the time period for each step are determined.

When an operator selectively changes the number of steps, the magnitude of each step and the time period of each step, the manipulating switches assigned to the preliminary contact data generate a preliminary contact data signal CT indicative of the number of newly provided steps, the magnitude of each newly provided step and the time period of each newly provided step, and the preliminary contact data signal CT is supplied to the music data generating unit 10*h*.

The hammer velocity signal HV, the damping data signal DM and the preliminary contact data signal CT are supplied to the music data generating unit 10*h*, and the music data generating unit 10*h* produces the music data code containing the key code information, the hammer velocity data information for one of the depressed keys 11*a*, the damping data information and the preliminary contact data information. The music data codes are supplied to the memory unit 10*j*, and are stored in the memory unit 10*j*.

The data supplying sub-system 10*b* further comprises a controlling unit 10*k* for sequentially actuating the solenoid-operated actuator units 10*a*. In detail, the controlling unit 10*k* sequentially reads out the series of music data codes from the memory unit 10*j*, and generates a driving signal DR on the basis of the music data code. The driving signal DR is selectively supplied to the solenoid coils 10*c* of the solenoid-operated actuator units 10*a* identified with the pieces of key code information respectively contained in the music data codes.

Figure 4A:
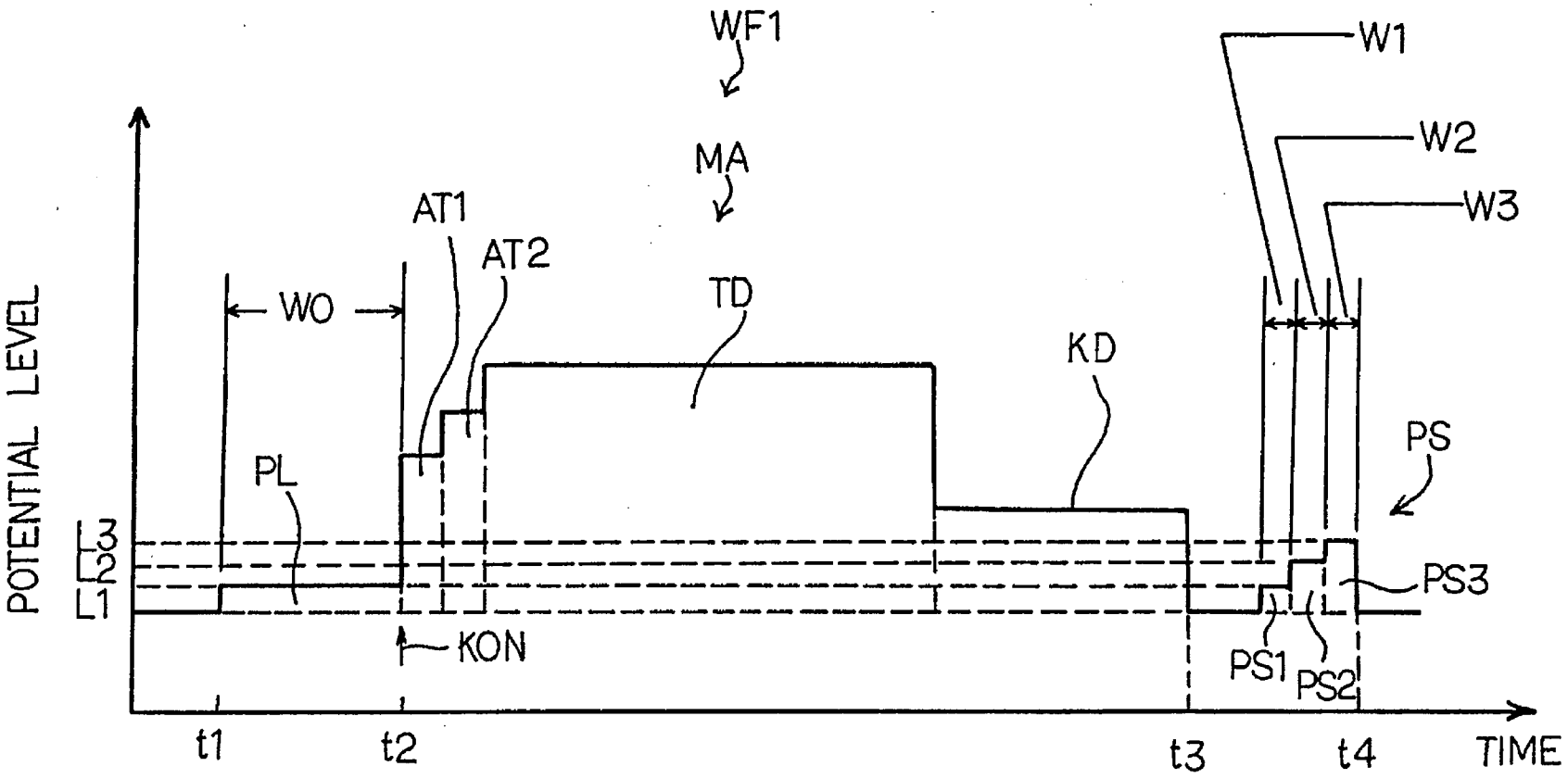
FIGS. 4A and 4B are diagrams showing the waveforms of driving signals produced by the automatic playing system.
Figure 4B:
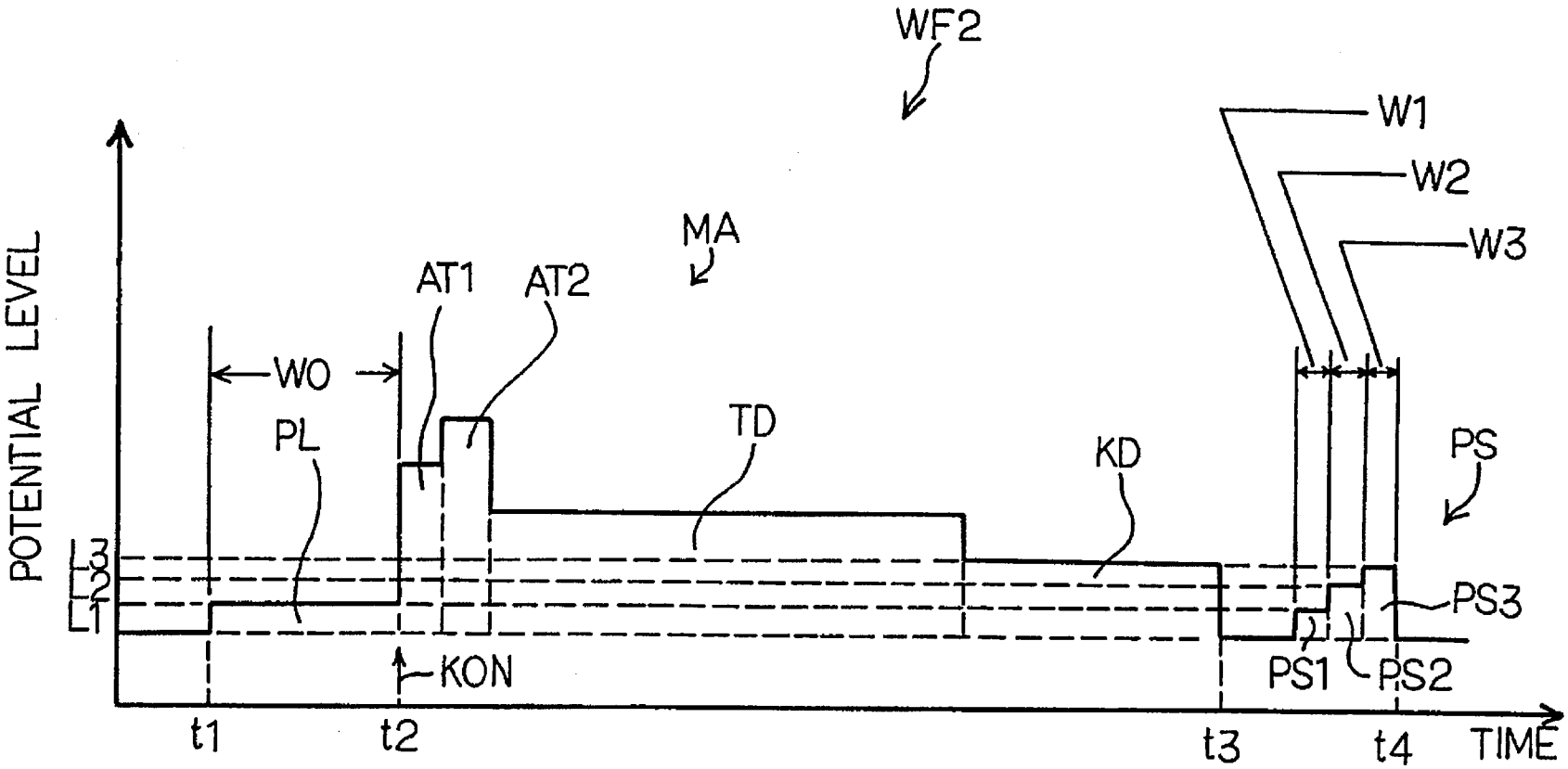

The driving signal DR has different waveforms depending upon the intensity of the impact of the hammer assembly 11*d* on the strings 11*e*. FIG. 4A illustrates the waveform WF1 for relatively strong impact ranging between the mezzo forte and the fortissimo, and FIG. 4B illustrates the waveform WF2 for relatively weak impact ranging between the mezzo piano and the pianissimo.

Each of the waveforms WF1 and WF2 is broken down into a preliminary section PL, a main section MA and a post-treatment section PS.

The preliminary section PL is tailored on the basis of the preliminary contact data. The width W0 of the preliminary section PL is equivalent to the time period of the step, and the potential level L1 is variable depending upon the magnitude of the step. Although the preliminary section PL shown in FIGS. 4A and 4B is constituted by a single step, the preliminary section PL may step-wise increase the potential level as similar to the post-treatment section PS by using the group of manipulating switches on the manipulating board 10*i*. The preliminary section PL rises at time t1 earlier than the leading edge of the first attack sub-section AT1 at time t2, and the time interval between time t1 and time t2 is longer than the width of the attack sub-sections. In this instance, the time interval between time t1 and time t2 is regulated to 500 milliseconds. However, the time interval between time t1 and time t2 may be changed depending upon the structure of the acoustic piano.

Since the potential level L1 of the preliminary section PL is lower than the potential level of the first attack sub-section AT1, the plungers 10*d* gently come into contact with the bottom surfaces of the associated keys 11*a* before the key-on timings t2, and the solenoid-operated actuator units 10*a* drive the keys 11*a* for rotation without a noise.

The main section MA is further broken down into a first attack sub-section AT1, a second attack sub-section AT2, a touch sub-section TD and a maintenance sub-section KD, and the first attack sub-section AT1 to the maintenance sub-section KD are similar to those of the prior art driving signal. For this reason, detailed description is omitted for avoiding repetition.

The post-treatment section PS is step-wise varied, and, accordingly, has three sub-sections PS1, PS2 and PS3 in this instance. The post-treatment section PS is tailored on the basis of the damping data. The number of sub-sections PS1 to PS3, the potential level L1/L2/L3 of each sub-section P1 to P3 and the width W1/W2/W3 of each sub-section P1 to P3 are corresponding to the number of steps, the magnitude of each step and the time interval of each step, and are variable through the manipulation of the group of manipulating switches on the manipulating board 10*i*. Since the post-treatment section PS step-wise increases the potential level L1/L2/L3, the rear end portions of the keys 11*a* softly land on the back rail without a noise after time t4.

The automatic playing system 10 selectively enters into a recording mode and a playback mode, and behaves as follows.

Assuming now that a player starts a performance on the keys 11*a* after the entry into the recording mode, the key sensors 10*d* produce the key code signals KD and the detecting signals DT for the depressed keys 11*a*, and the velocity detecting position designator 10*e* supplies the timing signals TM to the key velocity calculator 10*f*. The key velocity calculator 10*f* calculates the key velocities for the keys specified by the key code signal KC, and the hammer velocity estimator 10*g* estimates the final hammer velocities or the intensities of the impacts of the hammer assemblies 11*d* associated with the depressed keys 11*a*.

The preliminary contact data signal CT and the damping data signal DM have been already supplied to the music data generating unit 10*h*, and the music data generating unit 10*h* generates the music data codes MC indicative of the performance. The music data codes MC are stored in the memory unit 10*j*.

After the performance, if the player wants to reproduce the performance, the automatic playing system 10 enters into the playback mode, and the music data codes MC are sequentially read out from the memory unit 10*j*. The read-out music data codes MC are successively supplied to the controlling unit 10*k*, and the controlling unit 10*k* toilers the waveform WF1/WF2 for the driving signal supplied to the solenoid-operated actuator unit 10*a* associated with the key 11*a* specified by each music data code MC.

Each of the keys 11*a* is driven for rotation in the playback mode as follows. The controlling unit 10*k* firstly supplies the preliminary section PL to the solenoid-operated actuator unit 10*a*, and the preliminary section PL causes the solenoid coil 10*c* to generate electro-magnetic force, and the associated plunger 10*d* is slowly projected from the solenoid coil 10*c*, because the preliminary section PL generates weak electro-magnetic force. As a result, the plunger 10*d* comes into contact with the bottom surface of the associated key 11*a*: however, the plunger 10*d* does not rotate the key 11*a*. Moreover, the plunger 10*d* is previously in contact with the bottom surface of the key 11*a*, and, for this reason, variable time delay is not introduced in the key motion.

Subsequently, the controlling unit 10*k* supplies the first attack section AT1 at time t2 designated by the key-on timing, and the solenoid-coil 10*c* increases the electro-magnetic force. The second attack section AT2 is supplied to the solenoid-operated actuator unit 10*a*, and the plunger 10*d* strongly pushes the bottom surface of the key 11*a*. The plunger 10*d* has been already brought into contact with the bottom surface of the key 11*a*, and the key 11*a* starts the rotation without a noise.

The controlling unit 10*k* sequentially supplies the touch data section TD and the maintenance data section KD to the solenoid-operated actuator unit 10*a*. With the touch data section TD, the solenoid-operated actuator unit 10*a* regulates the final hammer velocity to the value in the corresponding hammer action in the original performance, and the strings 11*e* is struck by the hammer assembly 11*d* at the same intensity as that in the original performance. While the maintenance data section KD is being supplied to the solenoid-operated actuator unit 10*a*, the plunger 10*d* maintains the key 10*a* in the depressed state as similar to the actual fingering on the keys 11*a*.

The maintenance data section KD is expired at time t3, and the key 11*a* is released. The key 11 returns toward the rest position, and the controlling unit 10*k* supplies the post-treatment section PS on the way to the rest position. The solenoid coil 10*c* generates weak electro-magnetic force, and the electro-magnetic force is step-wise increased by the sub-sections PS2 and PS3. The electro-magnetic force gives a thrust in the opposite direction to the key motion to the plunger 10*d*, and the plunger 10*d* decelerates the key motion. As a result, the key 11*a* softly lands on the back rail at time t4, and a noise is not generated.

As will be appreciated from the foregoing description, the preliminary contact data and the damping data eliminates a noise from the key motion, and the automatic playing system 10 faithfully reproduces the original performance in the playback mode. While a player is performing a music on the keys 11*a*, the plungers 10*d* are retracted, and the key action mechanisms 11*c* and the hammer assemblies 11*d* give an ordinary key-touch to the player.

Although a particular embodiment of the present invention have been shown and described, it will be obvious to those skilled in the art that various changes and modifications may be made without departing from the spirit and scope of the present invention.

For example, the automatic playing system according to the present invention is applicable to any kind of musical instrument performable by means of solenoid-operated actuator units. One of the applicable musical instrument is a keyboard musical instrument disclosed in U.S. Pat. No. 5,374,775.

In the above described embodiment, both of the preliminary contact data and the damping data form parts of the music data code. However, the preliminary control data may directly supplied to the solenoid-operated actuator units 10*a*. In this instance, the preliminary data is independently changeable, and the music data codes are shared with another automatic player piano.

The preliminary section may be supplied to all of the solenoid-operated actuator units at all times. In this instance, the damping data is independently changeable.

In the above described embodiment, both of the preliminary section and the post-treatment section are supplied to the solenoid-operated actuator units 10*a*. However, only one of the preliminary section and the post-treatment section may be supplied to the solenoid-operated actuator units 10*a*.

What is claimed is:

1. An automatic playing system for an acoustic musical instrument having tone generating mechanisms for generating acoustic tones through string vibration, the system comprising:

data supplying means for successively supplying a plurality of pieces of tone intensity data, each piece of tone intensity data representing a volume of a tone produced by said acoustic musical instrument; and driving means for driving said tone generating mechanisms, said driving means further comprising force-transmitting means for exerting forces on said tone generating mechanism, said driving means being responsive to said pieces of tone intensity data so as to cause said force-transmitting means to exert forces corresponding to said pieces of tone intensity data on said tone generating mechanisms;

wherein said data supplying means further supplies pieces of preliminary driving data to said driving means so as to maintain said force-transmitting means in contact with said tone generating mechanism in the absence of said pieces of tone intensity data.

2. The automatic playing system as set forth in claim 1, wherein said data supplying means includes manipulating means for changing a value of each of said pieces of preliminary driving data.

3. An automatic playing system for an acoustic musical instrument having tone generating mechanisms movable between respective home positions to respective tone generating positions for generating acoustic tones through string vibration, the system comprising:

data supplying means for successively supplying a plurality of pieces of tone intensity data, each piece of tone intensity data representing a volume of a tone produced by said acoustic musical instrument; and driving means for driving said tone generating mechanisms, said driving means further comprising force-transmitting means for exerting forces on said tone generating mechanism, said driving means being responsive to said pieces of tone intensity data so as to cause said force-transmitting means to exert forces corresponding to said pieces of tone intensity data on said tone generating mechanisms;

wherein said data supplying means further supplies pieces of deceleration data to said driving means so as to decelerate said tone generating mechanisms while said tone generating mechanisms are moving from said tone generating positions toward said home positions, thereby causing said tone generating mechanisms to softly terminate movement at said home positions.

4. The automatic playing system as set forth in claim 3, wherein said data supplying means includes manipulating means for changing a value of each of said pieces of deceleration data.

5. An automatic player piano comprising:

an acoustic piano including a plurality of keys, each movable between a rest position and an end position, a player selectively depressing said plurality of keys in performance, a plurality of key action mechanisms functionally connected to said plurality of keys, respectively, a plurality of hammer assemblies driven for rotation by said plurality of key action mechanisms, respectively, and a plurality of strings respectively struck by said plurality of hammer assemblies for generating acoustic sounds; and an automatic playing system including a plurality of actuator units respectively associated with said plurality of keys, and having respective plungers so as to drive said plurality of keys for rotation instead of a player, and a controlling unit responsive to a series of music data indicative of a performance for selectively supplying a driving signal to said plurality of actuator units, a waveform of said driving signal having at least a preliminary section and a main section, said preliminary section causing the plunger of each actuator unit to be in contact with the associated key without a rotation of said key before a key-on timing, said main section causing said key to start the rotation by means of said plunger at said key-on timing.

6. The automatic player piano as set forth in claim 5, in which said preliminary section is supplied to each of said actuator units associated with one of the keys to be moved a predetermined time earlier than said key-on timing.

7. The automatic player piano as set forth in claim 6, in which said predetermined time is 500 milliseconds.

8. The automatic player piano as set forth in claim 5, further comprising a music data generating unit operative to generate said series of music data from said performance by said player.

9. The automatic player piano as set forth in claim 8, in which said music data generating unit includes a plurality of key sensors respectively associated with said plurality of keys for generating key signals each indicative of a motion of one of the keys moved by said player, a key velocity determining means responsive to said key signals for determining a key velocity of each key moved by said player, a hammer velocity estimating means for determining velocities of the hammer assemblies each associated with said key moved by said player, and a music data generating means for generating said series of music data each including a piece of impact data information corresponding to one of said velocities of said hammer assemblies and a piece of preliminary contact data information indicative of said preliminary section.

10. An automatic player piano comprising:

an acoustic piano including a plurality of keys each movable between a rest position and an end position, a player selectively depressing said plurality of keys in a performance, a plurality of key action mechanisms functionally connected to said plurality of keys, respectively, a plurality of hammer assemblies driven for rotation by said plurality of key action mechanisms, respectively, and a plurality of string means respectively struck by said plurality of hammer assemblies for generating acoustic sounds; and an automatic playing system including a plurality of actuator units respectively associated with said plurality of keys, and having respective plungers so as to drive said plurality of keys for rotation instead of a player, and a controlling unit responsive to a series of music data indicative of a performance for selectively supplying a driving signal to said plurality of actuator units, a waveform of said driving signal having at least a main section and a post-treatment section supplied to said plurality of actuator units after said main section, said main section causing each of said plurality of keys to start the rotation by means of said plunger of the associated actuator unit at a key-on timing, said post-treatment section causing said each of said plurality of keys to gently return to said rest position.

11. The automatic player piano as set forth in claim 10, in which said post-treatment section is supplied to said actuator unit associated with said each of said plurality of keys between a release of said each of said plurality of keys and an arrival at said rest position.

12. The automatic player piano as set forth in claim 10, in which said post-treatment section is step-wise increased in magnitude.

13. The automatic player piano as set forth in claim 10, further comprising a music data generating unit operative to generate said series of music data from said performance by said player.

14. The automatic player piano as set forth in claim 13, in which said music data generating unit includes a plurality of key sensors respectively associated with said plurality of keys for generating key signals each indicative of a motion of one of the keys moved by said player, a key velocity determining means responsive to said key signals for determining a key velocity of each key moved by said player, a hammer velocity estimating means for determining velocities of the hammer assemblies each associated with said key moved by said player, and a music data generating means for generating said series of music data each including a piece of impact data information corresponding to one of said velocities of said hammer assemblies and a piece of damping data information indicative of said post-treatment section.

15. The automatic player piano as set forth in claim 10, in which said waveform of said driving signal further has a preliminary section supplied to said plurality of actuator units before said main section, said preliminary section causing the plungers of said plurality of actuator units to be in contact with said plurality of keys before said key-on time.

16. The automatic player piano as set forth in claim 15, in which said preliminary section is supplied to each of said actuator units associated with one of said plurality of keys to be moved a predetermined time earlier than said key-on timing.

17. The automatic player piano as set forth in claim 16, in which said predetermined time is 500 milliseconds.

18. The automatic player piano as set forth in claim 15, further comprising a music data generating unit operative to generate said series of music data from said performance by said player.

19. The automatic player piano as set forth in claim 18, in which said music data generating unit includes a plurality of key sensors respectively associated with said plurality of keys for generating key signals each indicative of a motion of one of the keys moved by said player, a key velocity determining means responsive to said key signals for determining a key velocity of each key moved by said player, a hammer velocity estimating means for determining velocities of the hammer assemblies each associated with said key moved by said player, and a music data generating means for generating said series of music data each including a piece of impact data information corresponding to one of said velocities of said hammer assemblies, a piece of preliminary contact data information indicative of said preliminary section and a piece of damping data information indicative of said post-treatment section.

* * * * *